US006911247B2

(12) United States Patent
Howland

(10) Patent No.: US 6,911,247 B2
(45) Date of Patent: Jun. 28, 2005

(54) WEARABLE PROTECTIVE SYSTEM HAVING PROTECTIVE ELEMENTS

(75) Inventor: Charles Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 0 days.

(21) Appl. No.: 10/021,851

(22) Filed: Dec. 13, 2001

(65) Prior Publication Data

US 2002/0122927 A1 Sep. 5, 2002

Related U.S. Application Data

(60) Provisional application No. 60/255,289, filed on Dec. 13, 2000.

(51) Int. Cl.[7] ..... B32B 5/12

(52) U.S. Cl. ..... 428/114; 428/902; 428/911; 442/203; 442/196; 442/243; 442/324

(58) Field of Search ..... 428/911, 902, 428/114; 442/203, 243, 105, 196, 324

(56) References Cited

U.S. PATENT DOCUMENTS

| | | | | |
|---|---|---|---|---|
| 2,640,987 A | | 6/1953 | Ehlers | |
| 2,771,384 A | | 11/1956 | Collins | |
| 3,826,172 A | | 7/1974 | Dawson | |
| 4,090,011 A | * | 5/1978 | Barkman et al. | 428/653 |
| 4,574,105 A | * | 3/1986 | Donovan | 428/233 |
| 4,660,223 A | | 4/1987 | Fritch | |
| 4,911,061 A | | 3/1990 | Pivitt et al. | |
| 5,102,723 A | | 4/1992 | Pepin | |
| 5,185,195 A | * | 2/1993 | Harpell et al. | |
| 5,196,252 A | * | 3/1993 | Harpell | |
| 5,198,280 A | * | 3/1993 | Harpell et al. | 428/102 |
| 5,254,383 A | * | 10/1993 | Harpell et al. | |
| 5,362,527 A | * | 11/1994 | Harpell et al. | 428/33 |
| 5,364,679 A | | 11/1994 | Groves | |
| 5,668,344 A | | 9/1997 | Bornstein | |
| 5,824,940 A | | 10/1998 | Chediak et al. | |
| 6,534,426 B1 | * | 3/2003 | Chiou | 402/203 |

FOREIGN PATENT DOCUMENTS

WO WO 00/33013 6/2000

OTHER PUBLICATIONS

PCT International Search Report dated Jun. 28, 2002 of International Applications No. PCT/US01/48947 filed Dec. 13, 2001.

European Patent Office, Supplementary Partial European Search Report, Jan. 10, 2005, 4 pages.

* cited by examiner

*Primary Examiner*—Merrick Dixon
(74) *Attorney, Agent, or Firm*—Maine & Asmus

(57) ABSTRACT

A protective covering system having high-flexibility and low areal density characteristics. In one aspect of the invention, the protective system includes a plurality of metallic staples or wire elements secured to multi-layer matrix including woven fibers, the layers being oriented at cross angles to provide a grid-like pattern of protective elements. In one aspect of the invention, protective elements provide a coverage area of less than 90% and as little as 40% of total surface area. In one aspect of the invention, protective elements may be mechanically secured to a matrix by a puncture and crimp process. In another, wire elements may be attached or woven into one or more matrix layers.

21 Claims, 7 Drawing Sheets

WEARABLE PROTECTIVE SYSTEM HAVING PROTECTIVE ELEMENTS

This application is a non-provisional of U.S. provisional application Ser. No. 60/255,289 filed Dec. 13, 2000 and relates and claims priority for all purposes.

FIELD OF THE INVENTION

The invention relates to protective systems, such as body armor, including protective elements.

BACKGROUND OF THE INVENTION

There is a strong desire on the part of law enforcement, military organizations and others to increase the protection provided by protective systems, such as body armor. The demands placed on such protective systems are high. For example, wearers of body armor encounter a variety of different threats, such as hand guns, commercial and hand-made knives, ice picks, needles and others. Although some protective systems have been developed to counter these threats, the systems do not meet other requirements of weight and/or flexibility. For example, protective vests including large metal or ceramic plates may provide protection against likely threats, but are typically heavy and inflexible.

One protective vest that is commercially available from Highmark in the United Kingdom includes a plurality of aluminum tiles that are butted together and adhered to a supporting fabric, such as a woven polyester fabric. The close spacing and inflexibility of the metal tiles makes this vest unacceptable to some users because it is too heavy and stiff for comfortable wear as other than an outer vest or protective garment, and is not suitable for concealable use.

Other protective articles are described, for example, in U.S. Pat. Nos. 5,254,383; 5,198,280; 5,196,252; and 5,185,195, in which a plurality of planar bodies, such as small metallic pieces, are attached to fibrous layers. Planar bodies on one or more fibrous layers may overlap and provide resistance to penetrating objects. As with other armors of this type, the described protective garments were not accepted commercially because of their high weight and inflexibility.

The inventor is also aware of a glove that was developed for installing razor wire. The glove included a leather base material and had a plurality of metallic staples attached in the palm area of the glove. The staples were intended to protect the wearer's hand from slashing cuts of the razor wire.

SUMMARY OF THE INVENTION

An illustrative embodiment incorporating aspects of the invention provides a protective covering system resistant to penetration of an object, which can be configured as a wearable garment. The protective system includes a plurality of matrix layers, and a plurality of protective elements. At least two of the plurality of matrix layers each have a plurality of protective elements attached to or woven into the matrix layer in a pattern, and each of the protective elements is constructed and arranged to resist penetration of an object through a corresponding matrix layer upon contact of the object with one or more of the protective elements.

In another illustrative embodiment, a protective system includes a plurality of matrix layers with each matrix layer including a plurality of fibers. A plurality of protective elements are attached to or woven into the matrix layers.

Each matrix layer having attached protective elements includes at least one of (i) a flexibility to bend at least 180 degrees in at least one direction in a radius of not more than approximately 0.5 inches, (ii) an areal density of at most 2 lbs. per square foot, and (iii) less than 90% overall cover of the protective elements in a protection area on the matrix.

In another illustrative embodiment, a protective system is resistant to penetration of objects having an energy of at least 25 joules presenting an impact area of at most $1\times10^{-6}$ square inches. The protective system includes a matrix; and a plurality of protective elements attached to the matrix. The matrix with attached protective elements includes at least one of (i) a flexibility to bend at least 180 degrees in at least one direction in a radius of not more than approximately 0.5 inches, (ii) an areal density of at most 2 lbs. per square foot, and (iii) less than 90% cover of the protective elements in a protection area on the matrix.

In another illustrative embodiment, a protective system includes at least one matrix including a plurality of woven fibers, and metallic staples secured to the at least one matrix in a pattern. Each of the metallic staples is constructed and arranged to resist penetration of an object that contacts the metallic staple.

In another illustrative embodiment, a method for producing a protective system includes providing a matrix including interconnected fibers, puncturing the matrix in at least one area with a portion of a protective element, and bending the portion of the protective element that punctured the matrix so the protective element is mechanically attached to the matrix.

These and other aspects of the invention will be apparent from the following description and appended claims.

BRIEF DESCRIPTION OF THE DRAWINGS

Illustrative embodiments of the invention are described with reference to the following drawings, in which like reference numerals reference like elements, and wherein.

DETAILED DESCRIPTION

Figure 1:
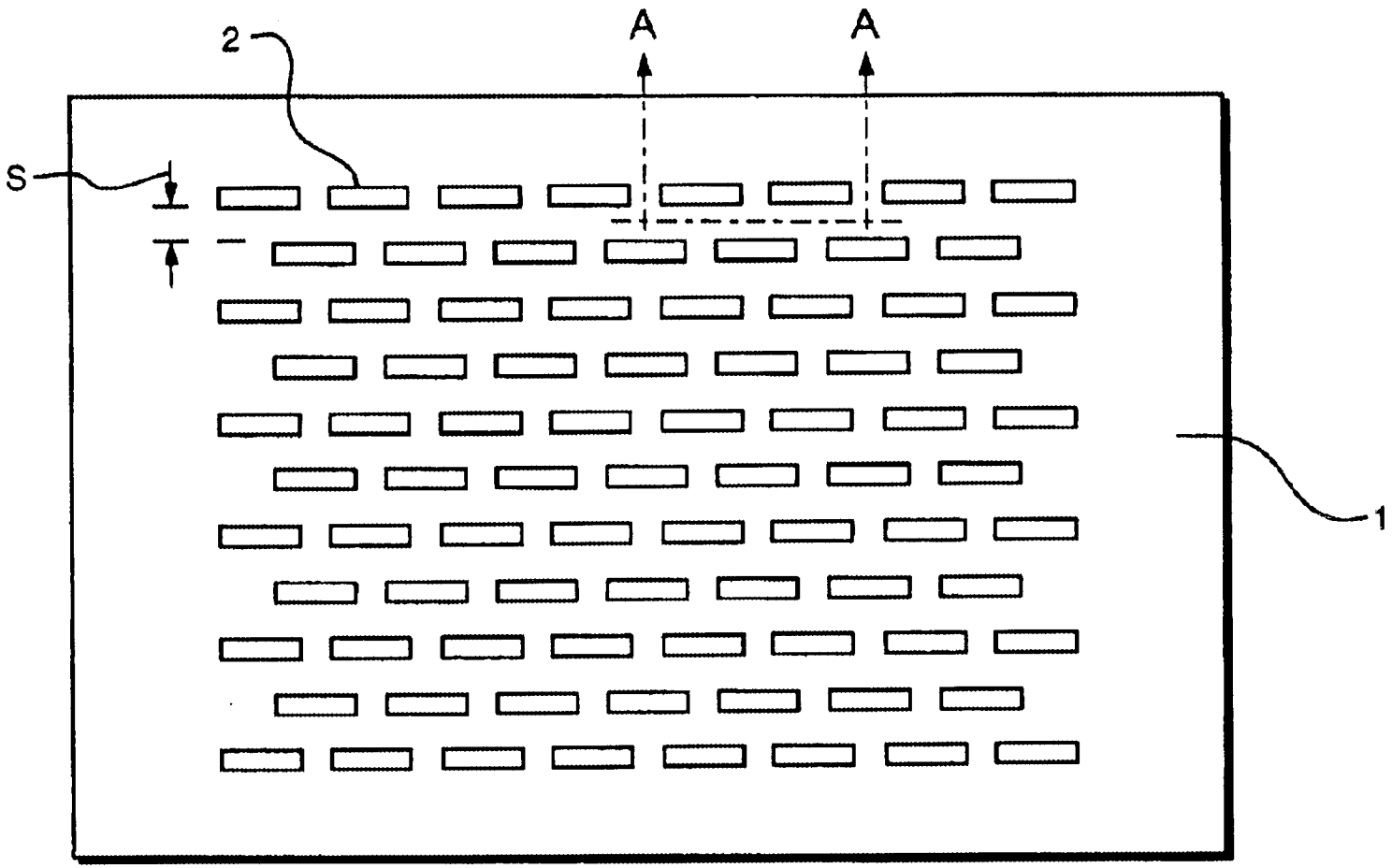
FIG. 1 is a plan view of a first illustrative embodiment of the invention having protective elements secured to a matrix.

Illustrative embodiments of the invention provide a protective covering system that is resistant to the penetration of objects that present a relatively small impact area upon impact with the protective system. For example, the object may be a knife, bullet, ice pick or other object that can present a relatively small impact area. As one example, when a knife is moved in a stabbing-type motion, the knife may impact a protective covering system with the tip of the knife. The protective covering system may also provide protection against objects that present a broader impact area, such as blunt striking objects like clubs, and other objects, such as knives that impact the protective system in a slashing-type direction where an extended length of the knife blade edge impacts the system. Illustrative embodiments of the invention may be incorporated into a wearable garment, such as a vest, jacket, glove, helmet, pants, boots, or other garment, or used in other applications, such as in a protective drape, curtain, cover or other device, where some degree of flexibility may be an inherent requirement.

Illustrative embodiments of the invention provide a lightweight, yet effective protective covering system. In one aspect of the invention, the protective system may be highly flexible, especially when compared to protective systems that provide comparable levels of penetration resistance. For example, the protective system, or portions of the protective system (such as those including protective elements), may be capable of bending up to 180 degrees in both directions, and may be capable of bending with a radius of as little as approximately 0.5 inches. Such flexibility lends greatly to the suitability of the system for configuration as a wearable garment, such as one worn on the hands, torso or other flexible portions of the body.

In one aspect of the invention, the protective system, or a portion of the protective system (such as those including protective elements), may have an areal density of at most 1.5 pounds per square foot (lbs/ft$^2$) yet still provide excellent resistance to penetrating objects. Such low areal density can provide an effective protective covering system that is lightweight; a feature that wearers appreciate in protective garments.

In one aspect of the invention, the protective system may have an overall protective coverage area provided by the multiple layers of protective elements of less than 90% of the total surface area of the system, e.g., as low as 40% overall coverage, and still provide excellent resistance to cutting-type penetrating objects, such as knives and razor blades. Many prior protective systems including protective elements, such as metallic pieces secured to a substrate, overlapped the protective elements so that at least 90% of the area of the protective system was covered by at least one protective element, their intent generally being to provide the maximum possible coverage. However, according to aspects of the invention, an overall cover of less than 90%, and as low as approximately 40% overall cover, may be provided while still providing effective resistance to penetrating objects, such as knives.

Illustrative embodiments of the invention include a woven layer or matrix of cord or fiber members or other suitable substrate that supports a plurality of protective elements secured thereto. The matrix, which may include a plurality of woven high-performance fibers, supports the protective elements in a uniform pattern of distribution so that one or more of the protective elements is available to contact a penetrating object and resist its penetration through the matrix. The protective elements may resist penetration of the object by breaking, bending or otherwise causing the object to perform mechanical work on the protective element and/or the matrix. The protective elements may also resist penetration of the object by breaking, bending or otherwise deforming or performing work on the object.

In one illustrative embodiment, protective elements may be spaced apart on a matrix at greater than the minimum possible distance, such as 0.1 to 0.5 inches, and still limit penetration of the designed-for objects through the matrix to acceptable levels. This aspect of the invention may provide a protective covering system that has desirable areal density and flexibility characteristics, since the coverage of the protective elements need not be 100% over the matrix. As a result, a protective system that is capable of resisting penetration of high energy objects, such as harder-jacketed high speed bullets or knives, may be provided at an areal density of 1.5 pounds per square foot or less, and/or a flexibility such that the protective system may be bent in at least one direction up to 180 degrees in a radius of 0.5 inches or less.

In one illustrative embodiment of the invention, the protective system may include at least one matrix that has a plurality of woven fibers or wires and metallic staples secured to the matrix in a pattern. Since the matrix may be made of a plurality of woven fibers, the matrix may be highly flexible, strong and lightweight by the inclusion of high performance fibers. Protective elements in the form of metallic staples allow simple, verifiable attachment of the staples to the matrix using a proven method: the puncture and crimp process used in common stapling processes such as that used to attach pieces of paper together. The metallic staple form for the protective elements also allows the staples to be made from high toughness materials formed using well-known methods, such as wire drawing processes. Alternately to or in combination with staples, continuous wires may be woven into the matrix at selected spacing so as to provide the desired density of protective elements.

FIG. 1 is a plan view of an illustrative embodiment of the invention. In this embodiment, a matrix 1 supports a plurality of protective elements 2 that are attached to the matrix 1 in a pattern of uniform distribution and directional orientation. The matrix 1 may be any suitable substrate, including a woven fabric of high-performance yarns, such as yarns made from para-aramid, high density polyethylene, liquid crystal polyester fibers and/or PBO. Although a matrix formed from woven high-performance fibers may be preferred in certain embodiments, the matrix may be made of, or include, lower performance fibers that are knitted or woven, or any other suitable substrate, such as leather, a sheet plastic material, a laminated material, or other.

The protective elements 2 may be made of, or include, any suitable material or materials. For example, the protective elements 2 may be made of any metallic, ceramic, plastic or composite (e.g., resin encapsulated fabric, ceramic materials and/or metallic reinforcing members). The protective elements 2 may also have any suitable shape and/or size, such as a rectangular shape shown in FIG. 1, a triangular shape, rod-like shape, circular shape, and so on, and may have different shapes. For example, the protective elements 2 secured to a matrix 1 may have different shapes and/or sizes, and be arranged in a tiled or other suitable fashion to provide a suitable type or amount of coverage over the matrix 1. The protective elements 2 may be attached to the matrix 1 in any suitable way, such as by mechanical fasteners, embedding portions of the protective elements 2 into portions of the matrix 1, by an adhesive, securing the protective elements 2 within pockets or other cavities formed in or on the matrix 1, by interweaving of the protective elements into the matrix, and so on.

In some embodiments, the protective elements 2 are secured to the matrix 1 so that work must be performed by an object upon impacting a protective element 2 and attempting penetration. Such work may be bending, breaking or otherwise deforming the protective element 2, stretching, sliding or otherwise moving fibers in the matrix 1 relative to other fibers in the matrix 1, and/or bending, breaking or otherwise deforming the penetrating object. Thus, for example, the protective elements 2 may be firmly secured to or within a tightly woven fabric so that the elements 2 are not easily moved either within or out of the plane of the fabric without performing work on the elements 2 and/or the fabric.

Figure 2:
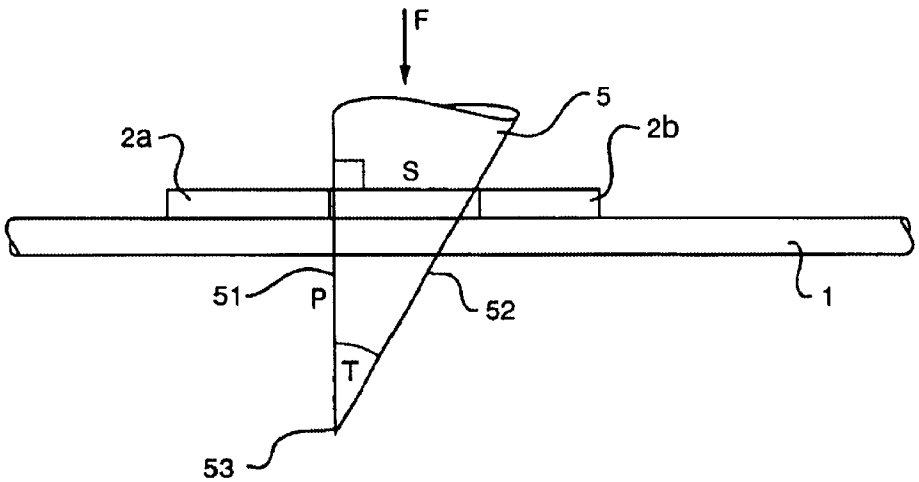
FIG. 2 is a cross-sectional view of an illustrative embodiment in which penetration of a knife-type object is being resisted by protective elements attached to a matrix.

One aspect of the invention shown in FIG. 1 is that the protective elements 2 are spaced apart approximately a spacing distance S from adjacent protective elements 2. The inventor has discovered that the protective elements 2 need not be arranged closely together to provide effective resistance to penetration of certain objects through the matrix 1 more than a maximum penetration distance P. For example, FIG. 2 shows an object 5 (in this case a knife tip) that has penetrated through the matrix 1 a distance P. Given that the penetration distance P is maintained below an acceptable threshold distance, the protective elements 2 can be spaced apart on the matrix 1 and yet provide acceptable penetration resistance. Thus, the spacing S between protective elements 2 may be determined based on the types of threats expected and their geometries. For example, the object 5 shown in FIG. 2 has a tip 53 with an angle T. Given the angle T and the maximum acceptable penetration distance P, the spacing distance S can be calculated, e.g., according to the equation S=P*Tan(T). The inventor has found that a distance S between 0.1 and 0.5 inches limits knife penetration to acceptable levels. The spacing distance S may be established between protective elements 2 attached to a same matrix 1 or between elements 2 attached to different matrices 1, e.g., when matrices 1 are layered in a protective system as described more fully below.

In the illustrative embodiment shown in FIG. 2, a first side 51 of the object 5 is in contact with a first protective element 2*a* and a second side 52 of the object 5 is in contact with a second protective element 2*b*. That is, the penetrating force F of the object 5 downward in FIG. 2 is resisted by contact of the protective elements 2*a* and 2*b* on the sides 51 and 52 of the object 5. The object 5 has been stopped in its penetration through the matrix 1 in the position shown in FIG. 2 by the resistance of the matrix 1 preventing the further separation of the protective elements 2*a* and 2*b*. For example, if the matrix 1 is a matrix of woven fibers, fibers in the matrix 1 resist separation of the protective elements 2*a* and 2*b* more than the distance S, e.g., by resisting stretching, breaking or sliding as the protective elements 2*a* and 2*b* are forced apart by the object 5.

Contact of the protective elements 2*a* and/or 2*b* with the edges 51 and/or 52 of the object 5 may roughen portions of the edges 51 and 52, thereby causing fibers in the matrix 1 to catch on the roughened portions, and further resist penetration of the object 5. Work done on the object edges 51 and 52 and/or on the protective elements 2*a* and 2*b* may be caused by friction between the object 5 and the protective elements 2, as the object 5 attempts to penetrate the matrix 1. This friction may cause the protective elements 2 to plastically deform or break (thus transferring penetration energy of the object 5 to the protective elements 2 and/or the matrix 1), or deformation, breakage or other work to be performed on the object 5. In some cases, where the object 5 and the protective elements 2 are metallic, heat caused by friction may cause the object 5 and protective elements 2 to be welded together (at least temporarily and in localized areas). This welding may cause the object 5 to more efficiently transfer energy to the protective elements 2 and the matrix 1 since force of the object 5 is more directly transferred to the protective elements 2, causing bending, breakage, stretching, etc. of the elements 2, the object 5 and/or fibers in the matrix 1.

Figure 3:
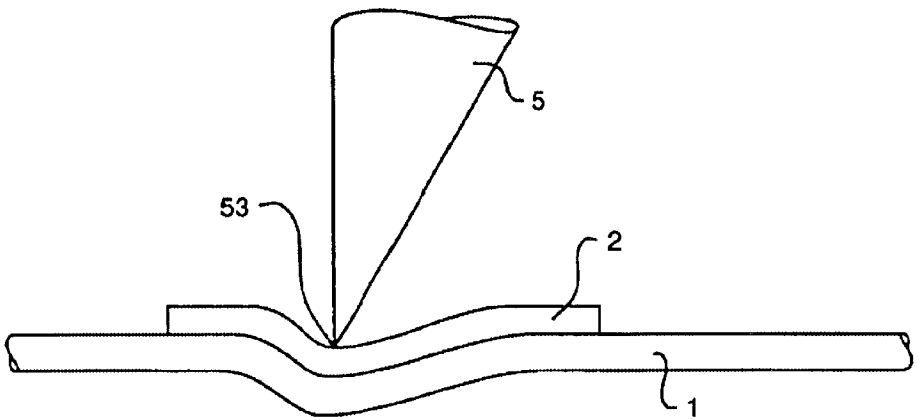
FIG. 3 is a cross-sectional view of an illustrative embodiment in which the penetration of a knife-type object that has directly impacted a protective element is being resisted.

The example shown in FIG. 2 is one in which the object 5 is initially introduced in an area of the matrix 1 between protective elements 2. However, in some cases, the object 5 may directly impinge on a protective element 2, as shown in FIG. 3. In the example shown in FIG. 3, the tip 53 of the object 5 has directly contacted a protective element 2. In this example, the protective element 2 has plastically deformed to absorb some of the penetration energy of the object 5. Energy of the object 5 may also be transferred to the matrix 1, which responds by catching the protective element 2 and resisting downward movement of the object 5.

Selection of the composition for the protective elements 2 and attachment or incorporation of the elements 2 into the matrix 1 can be important factors for properly resisting penetration of an object 5. For example, a typical knife threat delivers 25–110 joules in a single attack at speeds of approximately 5–15 meters per second. Thus, the bond between a protective element 2 and the matrix 1 should preferably be able to provide enough holding strength to withstand an attack of this type. Selection of the material or materials being used in the protective elements 2 may also be important in resisting the penetration of objects 5.

Figure 4:
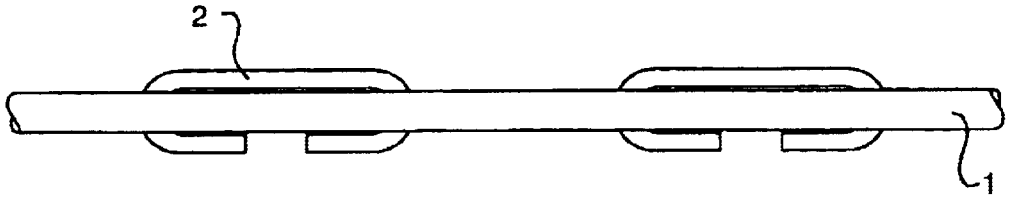
FIG. 4 is a cross-sectional view of an illustrative embodiment in which the protective elements are metallic staples secured to a matrix.

For example, if the protective elements of this or other embodiments are metallic elements, irrespective of form such as staples as in FIG. 4, or woven wires as in FIGS. 9–13, the metal used may have a very high energy absorption capability, i.e., toughness. For example, the metal may have a high hardness to resist cutting by a penetrating object 5 and a high tensile strength to avoid failure at the peak force of impact of the object, e.g., to properly resist penetration in a situation such as that shown in FIG. 3. The metal may also have enough ductility to allow crimping, bending or other deformation, e.g., when attaching the protective element 2 to the matrix 1 and to reduce the peak force at impact by deforming under load. The metal may also have or be provided with corrosion resistance so that the protective system has an acceptable service life. For example, the protective elements 2 may be made of a stainless steel or coated with a material to prevent corrosion, e.g., caused by moisture from a wearer's perspiration, rain or other environmental sources.

A number of high strength steels may have the proper mix of hardness, tensile strength and ductility to function well in high performance body armor applications. For example, austenitic stainless steels that are work hardened, e.g., such as that provided in a wire drawing process, may have desired properties for protective elements. Tooling grade steels such as the Areomet Alloy Series from Carpenter Steel, Inc. are examples of other metals that may have suitable characteristics. In general, Charpy impact toughness values for metals may be used in designing protective elements. For example, metals having a Charpy impact toughness of 30 ft lb and up may be desirable. Of course, the material and/or construction for the protective elements may depend upon the penetrating object to be protected against. In some applications, protective elements that have a very high hardness, but low ductility may be desired, e.g., when the protective elements are used to provide a first line of defense from very hard objects.

The protective elements may be composite elements that are made of a plurality of different materials. For example, a protective elements may have a metal base that is coated with a very hard, but low ductility material, such as ceramic, diamond or other similar materials. This combination may provide a protective element that is capable of roughening a penetrating object with the high hardness coating material, while absorbing impact energy of the object with the higher toughness base metal. The protective elements may also include composite elements made from a resin, such as a high modulus epoxy formed around a matrix of high strength fibers. These composite elements may also include high hardness elements, such as small pieces of ceramic or other similar material, and/or high toughness materials, such as one or more metallic strips. In short, the protective elements may be formed in any suitable way and include any suitable material or combination of materials.

FIG. 4 shows a cross-sectional view at A—A in FIG. 1 in an illustrative embodiment in which the protective elements 2 are mechanically attached to the matrix 1. In this illustrative embodiment the protective elements 2 are formed much like conventional wire staples. That is, opposite ends of the protective elements 2 are forced through, i.e., puncture, the matrix 1 and the ends are crimped toward each other. In this illustrative embodiment, it is preferred that the crimped ends of the protective element 2 lie approximately flat along the matrix 1 so that the matrix 1 is tightly gripped between portions of the protective element 2 on opposite sides of the matrix 1. However, the crimped ends of the protective element 2 may have some degree of curvature so that the matrix 1 is not uniformly gripped over the length of the crimped ends to the body of the protective element 2. The material used to form staple-type protective elements may be any of the metallic materials described above and may have any suitable cross-section, such as round, rectangular, or other. In addition, the protective elements may be mechanically fastened to a matrix 1 in ways other than the puncture and crimp process used in the illustrative embodiment shown in FIG. 4. For example, protective elements 2 may be secured using a rivet-type connection, or weldment or epoxy bond.

Using a staple-like protective element 2 may provide various advantages over some other protective element arrangements. For example, the staples may be made from a metallic material, such as stainless steel wire that has been work hardened by a wire drawing process. Wire drawing processes are a well-known and established way of improving the toughness of materials. In addition, puncture and crimp processes, i.e., stapling processes, are well-known and can be performed at high speed, allowing a protective system to be relatively quickly and inexpensively manufactured. In addition, the puncture and crimp process can be performed with metals having suitable properties to resist knife penetration, which is one of the more difficult objects to resist.

Protective elements 2 secured using a puncture and crimp process are also easily verified, which is an important aspect in protective systems. That is, the matrix 1, having protective elements 2 attached using a puncture and crimp process can be visually inspected to ensure that all of the protective elements 2 are securely fastened and are damage-free. This is in contrast to other protective systems, such as chain mail, in which it can be extremely difficult to inexpensively verify that the numerous welds and other physical properties needed in the chain mail to resist penetration of an object 5 are acceptable.

Figure 5:
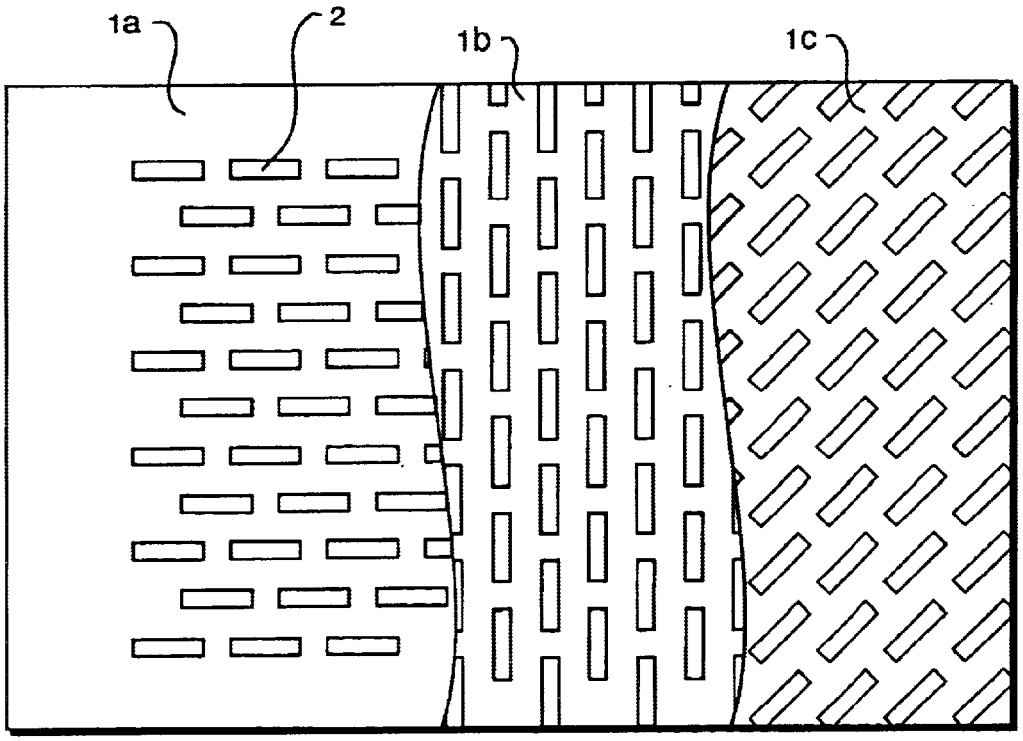
FIG. 5 is a plan view of an illustrative embodiment of the invention in which three matrix layers each include protective elements and the protective elements are oriented in different directions.

The puncture and crimp process also allows the protective elements 2 to be patterned on the matrix 1 in any suitable way. For example, FIG. 5 shows an illustrative embodiment of a protective system having three matrix layers 1A–1C. The matrix layer 1A has protective elements 2 attached to it in a running bond pattern using the puncture and crimp process. The term running bond pattern refers to the arrangement commonly found in brick walls in which adjacent rows of elements are offset so that the gap between elements in a first row is spanned an element in an adjacent row. A second matrix layer 1B underlying the first matrix layer 1A has protective elements 2 attached to it in a running bond pattern that is oriented generally perpendicular to the orientation in the layer 1A. A third matrix layer 1C underlies the matrix layer 1B and has protective elements 2 in a running bond pattern oriented at approximately a 45 degree angle to the patterns in the matrix layers 1A and 1B. This type of overlapping arrangement of protective elements 2 having different orientations and/or patterns may be useful in ensuring that there is no area in the protective system through which an object 5 having a minimum impact area may pass without impacting a protective element 2.

This arrangement may also allow the protective elements 2 within each matrix layer 1A–1C to be spaced apart so that each layer has a desired flexibility and/or areal density. That is, by positioning the protective elements 2 at a separation distance S from each other may allow the matrix 1 to be bent, e.g., bent 180 degrees in a radius of 0.5 inches or less, whereas if the protective elements 2 were placed more closely together, the matrix 1 may not be so flexible. Flexibility in a multi-layer protective system can provide for a more wearable garment, such as a vest, gloves, or pants.

Although running bond patterns are shown in these illustrative embodiments, any suitable pattern may be used. In addition, the protective elements 2 may not necessarily all have the same shape or size. Instead, protective elements 2 having different shapes may be combined together to form a desired pattern. Moreover, the pattern of elements 2 within each layer of a multi-layer protective system may be designed with other patterns in the system in mind. For example, protective elements 2 in a first matrix layer 1A may be spaced apart so that an object 5, such as a knife, may be able to pass through the matrix layer 1A without contacting a protective element 2. However, an underlying layer 1B may have protective elements aligned with the gaps between the protective elements 2 in the first matrix layer 1A. Similarly, if there are areas through which an object 5 may penetrate through the matrix layers 1A and 1B, a third underlying matrix layer 1C may have protective elements 2 arranged to cover such gaps. Thus, the protective elements 2 need not have a 100% cover within any single layer, and may not necessarily have 100% cover overall of the elements in a protective system for the reasons explained above.

Figure 6:
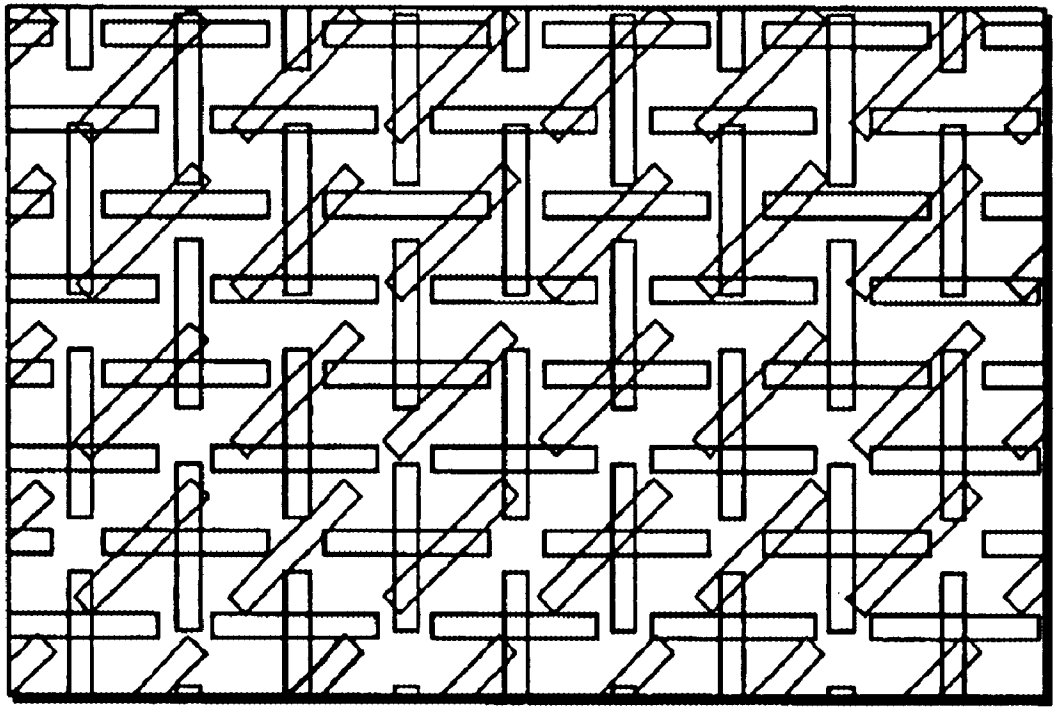
FIG. 6 shows a schematic view of an overlapping pattern of protective elements in an illustrative embodiment of the invention.

For example, FIG. 6 shows a schematic view of a pattern of protective elements 2 as they may be superimposed over each other in a protective system such as that shown in FIG. 5. The inventor has found that 0.1–0.5 inch spacing between protective elements 2 within each matrix layer 1A–1C limits knife penetration to acceptable levels. With such a spacing between protective elements 2 (which in a preferred embodiment have a width of approximately 0.030 to 0.050 inches and a length 0.375 to 0.75 inches), the superimposed patterns of protective elements 2 do not have, and need not have, 100% coverage over a protected area. Instead, the protective elements 2 may have an overall coverage of less than 90% and still provide adequate protection. For example, using the 0.1–0.5 inch spacing, uncovered areas having a size up to 0.5 by 0.25 inches can occur in the system while still providing acceptable resistance to penetration of cutting-type objects, such as knives. In one illustrative embodiment, two overlapping matrix layers 2 each having approximately a 20% coverage of protective elements (thus providing approximately an overall coverage of 40%) has been found to provide adequate resistance to cutting-type penetrators.

Figure 7:
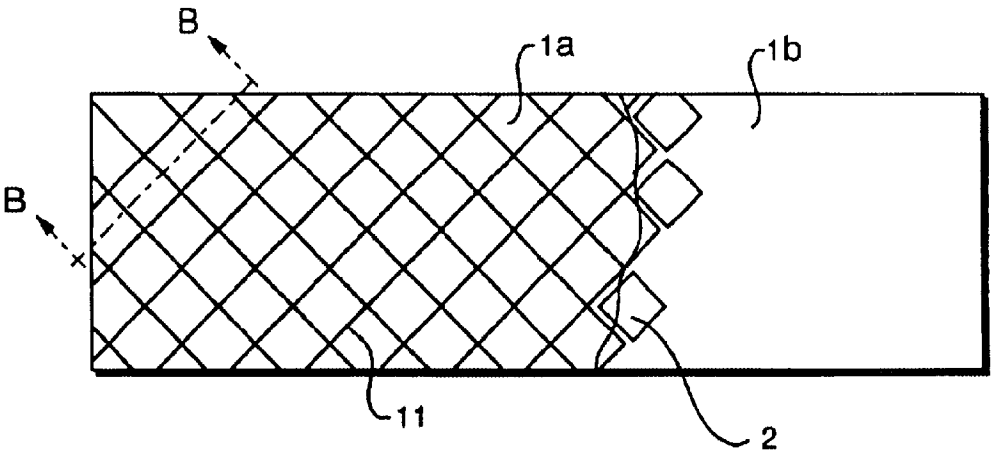
FIG. 7 is an illustrative embodiment in which protective elements are secured in pockets between two matrix layers.
Figure 8:
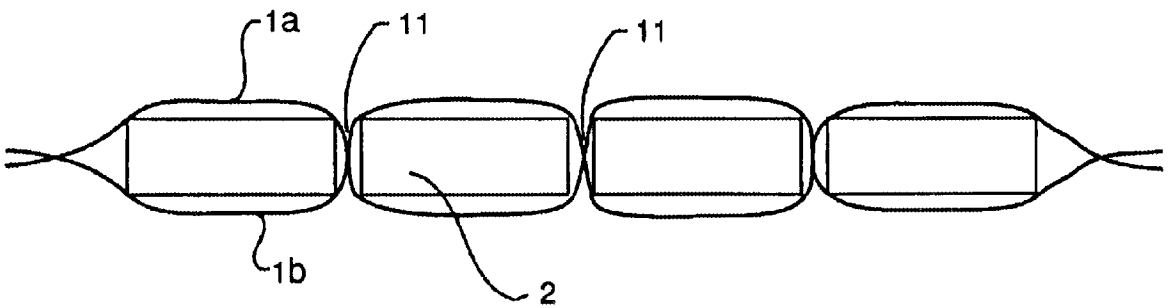
FIG. 8 is a cross-sectional view of a portion of the embodiment of FIG. 8.
Figure 9:
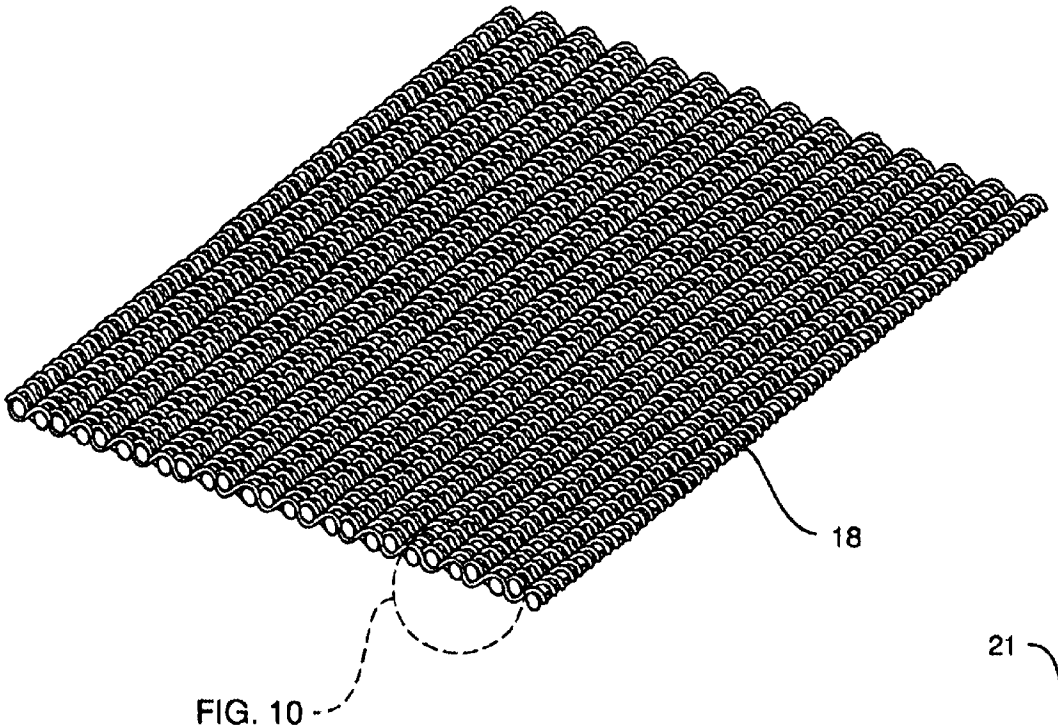
FIG. 9 is a substrate into which protective wire strands have been woven.
Figure 10:
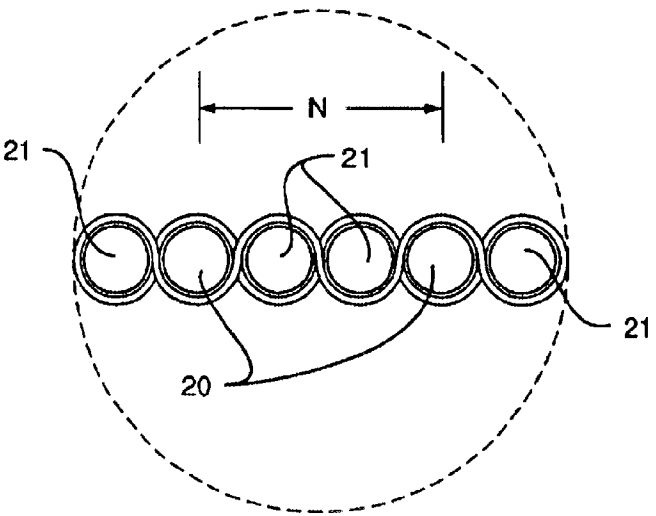
FIG. 10 is a partial edge view of the substrate of FIG. 9, illustrating the placement of the protective wire strands in the weave.
Figure 11:
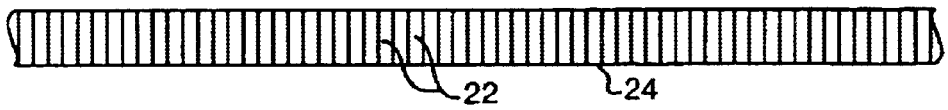
FIG. 11 is a plan view of a strip taken from the substrate of FIG. 9, with the wire strands cut into protective wire elements running spanwise of the strip.
Figure 12:
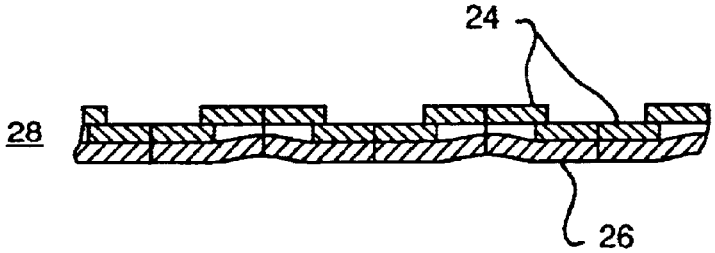
FIG. 12 is a partial cross section view of a matrix layer made up of two FIG. 11 strips applied to a carrier substrate.
Figure 13:
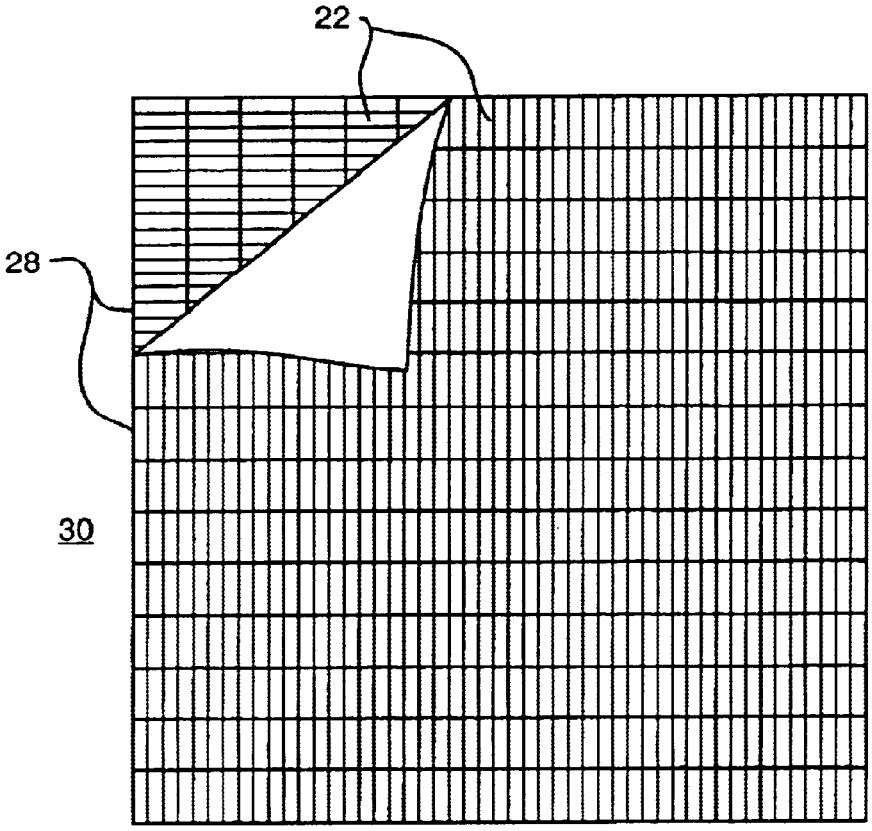
FIG. 13 is a peeled back perspective view of a protective covering made up of two of the matrix layers of FIG. 12, oriented orthogonally so as to place protective wire elements at right angles as between layers.

FIG. 7 shows a plan view of another illustrative embodiment of the invention. In this embodiment, rectangular protective elements 2 are secured between two matrix layers 1A and 1B to form an assembly. The protective elements 2 are kept in place by lines of stitching 11 that join the matrix layers 1A and 1B between protective elements 2. FIG. 8 shows a cross-section of the FIG. 7 embodiment at the line B—B. The protective elements 2 are captured in pockets formed between the matrix layers 1A and 1B by the lines of stitching 11. The matrix layers 1A and 1B may be made of any suitable material, including woven fabrics of high performance fibers, such as para-aramids, high density polyethylenes, liquid crystal polyesters and PBO. If shrinkage is desired (discussed more fully below), high-tenacity nylon and polyester fibers may be used. The lines of stitching 11 may be replaced with other joining elements, such as lines of thermal welding, adhesive, mechanical fasteners and so on.

According to one aspect of the invention, given that the matrix layers 1A and 1B are made of a suitable material, the assembly including protective elements 2 captured between the matrix layers 1A and 1B may be shrunken, e.g., by applying heat to the matrix layers 1A and 1B. Shrinking the matrix layers 1A and 1B can draw the protective elements 2 toward each other and minimize any spacing between the protective elements 2. This aspect of the invention is not limited to the embodiment in which protective elements 2 are secured within pockets between attached matrix layers 1A and 1B. Instead, any single or group of matrix layers 1 having attached protective elements 2 may be shrunken using any suitable process to bring the protective elements 2 closer together or to otherwise position the elements 2 relative to each other. Thus, a matrix 1 having staple-type protective elements 2 may be shrunken to properly position the elements 2.

As in any of the embodiments above, a protective system may be made of two or more layers of overlapping matrix layer/protective element assemblies shown in FIGS. 7 and 8. The assemblies may be offset and rotated relative to each other, e.g., by approximately 30° relative to each other, to form a protective system that has a minimum number and area of gaps between the protective elements 2.

As in the embodiments described above, the protective elements 2 used in the embodiment shown in FIGS. 7 and 8 may be made in any suitable way and their construction may depend upon the type of object 5 to be resisted. For example, the protective elements 2 may be metal plates, ceramic tiles used in ballistic protection systems, and/or composite elements. In an illustrative embodiment, composite protective elements 2 include laminated layers of woven fabric bonded together with a high modulus epoxy resin. For example, each protective element 2 may have four to seven layers of woven fabric made of para-aramid yarns that are bonded together by an epoxy resin having a tensile modulus of approximately $5\times10^5$. The protective elements may have 20–40% resin by weight and the fabric layers may have a low cover factor or other features to allow thorough resin penetration. The fabrics may also have a low crimp to provide a higher tensile stress with less elongation of the protective element 2 and/or may be pre-stressed while the resin is hardened. Lower percent resin protective elements have been found to perform better in ballistic applications, whereas higher percent resin protective elements have been found to perform better when resisting penetration of sharp objects 5, such as knives and/or ice picks. The composite protective elements 2 may be made in any suitable shape and/or size, such as squares having a size of 4×4 inches down to ¼×¼ inches. As in the embodiments above, differently shaped and/or sized protective elements 2 may be arranged together in any suitable way.

The composite protective elements 2 may also include relatively hard inclusions to increase the coefficient of friction of the protective element 2 on a penetrating object 5. For example, the protective elements 2 may include grains of ceramic materials having a size of 0.02–0.1 inches. These inclusions may be chosen to have a hardness higher than typical knife or other penetrating object 5 materials so that the inclusions may roughen or otherwise damage the surface of the penetrating object 5, thereby allowing more efficient capture of the object 5 by fabric layers or other portions of the protective system. The protective elements 2 may include any suitable percent range by weight of inclusions, such as 10–75% inclusions. The inclusions themselves may have any suitable shapes, such as spherical, cubic, tetrahedral, rectangular solid, ovoid or cylindrical. The inclusions may also have a high compressive strength to help stop the propagation of cracks or cuts through the protective element 2 upon impact of an object 5. Drawn metallic wire elements may also be used as inclusions. These inclusions have the advantage of intrinsically having high aspect ratios of length to width. These high aspect ratio inclusions give protection without unneeded extra weight.

Referring now to FIGS. 9–13, a further embodiment of the invention utilizes a cross pattern of protective wire elements 22 incorporated into a multi-ply garment material. The wire is selected as described above for other protective elements and embodiments. In a preferred methodology for fabricating this embodiment, a pattern of parallel wires 20 is woven into a substrate 18 fabricated of high modulus yarn, with uniform spacing N between the wires, the wires 20 replacing or supplementing some fibers 21 in the weave. The substrate is then reduced to strip tapes 24 with the protective wire elements 22 running spanwise in the tapes, at distance N apart, this being the functional equivalent to distance S in the prior embodiments.

In this embodiment, tapes 24 are securely applied in an overlapping fashion to a carrier 26 to form a unidirectional matrix layer 28. Carrier 26 may be a woven fabric or a substrate of various compositions as has been described elsewhere herein. Then two or more of these matrix layers 28 are rotated to offset angles such as 90 degrees apart for two plies, or 60 degrees apart for three plies, and laminated to forma multi-ply fabric 30 with protective wire elements 22 oriented in a protective grid pattern that functions similarly to the patterns of protective elements in other embodiments such as in FIG. 5. The high modulus fibers secure the protective wire elements securely in place with respect to lateral movement in the plane of the fabric 30. The multiple plies of the fabric and resulting grid pattern of protective elements assure that striking objects will be resisted by the wire grid and carrier layers, each wire element absorbing and transferring energy in the same manner as the protective elements of the prior embodiments.

This embodiment is shown with overlapped tapes in each layer, providing effectively continuous wire elements in each orientation, with the two layers oriented at 90 degrees so as to form a simple square grid pattern. Other embodiments may simply butt the tapes edge to edge in each layer, and orient the layers at angles other than 90 degrees, so long as a suitable grid pattern is formed that will contain striking objects within the design limits of the protective system. For example, there may be at least three layers of wire elements in the finished material, tapes butted edge to edge in each layer, with each layer oriented at 60 degrees from the other two layers to assure the integrity of the protective wire grid as to striking objects.

Protective covering systems made using any of the various aspects of the invention may be designed to resist penetration of a wide variety of different objects, such as knives, sharp round objects such as ice picks and needles, bullets (whether soft deformable projectiles or hard armor piercing or semi-armor piercing projectiles), and/or blunt striking weapons. Protective systems may alternately be designed to protect against a particular type of object, such as providing protection against knives and similar penetrators, but not necessarily for providing ballistic protection. Thus, a protective system may include, for example, one or more matrix layers with protective elements, such as that shown in FIG. 5 which has been shown highly resistant to knife penetration, combined with a ballistic protection set, such as a plurality of layers of woven fabric made of high performance fibers, and/or a plurality of high cover fabrics for providing resistance to penetration of round objects, such as ice picks and needles. High cover fabrics suitable for protecting against round penetrators are described, for example, in U.S. Pat. Nos. 5,837,623 and 5,976,996.

Another option in providing a protective covering system may include attaching protective elements, such as the staple-type protective elements shown in FIG. 4 to high cover fabrics suitable for protection against penetration of round objects. Thus, the arrangement of protective elements in the high cover fabric may provide suitable penetration resistance to knives and other similar objects, while the high cover fabric provides resistance to penetration of round objects. The tight construction of the high cover fabrics may be particularly useful because it prevents the protective elements from shifting fibers within the matrix without transferring energy of the penetrating object to the underlying matrix 1. In contrast, a more low cover fabric may allow protective elements to more easily move laterally in the plane of the matrix without transfer of substantial energy from the protective elements to the matrix. Thus, including protective elements in lower cover fabrics may not be suitable for some applications.

The high cover fabrics may also include coatings, such as a polymer coating having embedded abrasive materials, to improve their resistance to round object penetration. It should be said that although high cover fabrics are used to resist penetration of round objects, one or a few layers of these fabrics have not been found sufficiently resistant to prevent a staple-type protective element from being suitably attached to the layers(s) using a puncture and crimp process.

Although various embodiments shown above have protective elements arranged in patterns such that less than 100% overall coverage of protective elements is provided, the protective elements may be arranged to provide greater than 100% coverage, if desired. That is, although spacing the protective elements may provide a lightweight and flexible system that has adequate protection against knife attacks, protective elements may be more closely spaced or highly overlapped, e.g., to provide improved protection against round penetrators. Such high overall coverage may be provided in addition to, or in place of, the use of high cover fabrics that are resistant to round penetrators. Thus, various aspects of the invention are not limited to the embodiments described above.

Although the invention has been described in connection with illustrative embodiments thereof, it should be understood that these embodiments are intended to illustrative, and not limiting. Various alterations, modifications and variations will be apparent to those skilled in the art. Various changes may be made without departing from the spirit and scope of the invention.

What is claimed is:

1. A protective covering system resistant to penetration of an object, comprising:

a plurality of matrix layers; and a plurality of protective elements, each of at least two of said matrix layers having a plurality of said protective elements attached to the matrix layer in a uniform pattern, the protective elements being constructed and configured in respective matrix layers to resist penetration of an object having an energy of at least 25 joules and presenting an impact area of at most $1\times10^{-6}$ square inches upon contact of the object with said protective elements.

2. A protective covering system according to claim 1, resistant to penetration of said objects having an energy of at least 25 joules presenting an impact area of at most $1\times10^{-6}$ square inches.

3. A protective covering system according to claim 1, at least one said matrix layer having a plurality of fibers.

4. A protective covering system according to claim 1, at least some of said protective elements comprising metallic staples secured to at least one said matrix layer.

5. A protective covering system according to claim 1, at least some of said protective elements comprising wire elements woven into at least one said matrix layer.

6. A protective covering system according to claim 1, at least one said matrix layer having flexibility to bend 180 degrees in at least one direction with a radius of not more than approximately 0.5 inches.

7. A protective covering system according to claim 1, wherein each matrix layer has an areal density of at most 1.5 lbs. per square foot.

8. A protective covering system according to claim 1, having an areal density of at most 2 lbs. per square foot.

9. A protective covering system according to claim 1, wherein the protective elements are attached to each matrix layer and the matrix layers oriented so that the protective elements provide a protective coverage area of less than 90% of total surface area of said system.

10. A protective covering system according to claim 1, wherein the protective elements are attached to each matrix layer and the matrix layers oriented so that the protective elements provide a protective coverage area of approximately 40% to 90% of total surface area of said system.

11. A protective covering system according to claim 1, wherein the protective elements are interconnected with each other only through respective said matrix layers, and are not directly interconnected with each other.

12. A protective covering system according to claim 1, wherein at least one said matrix layer is a high cover fabric that is resistant to round object penetration.

13. A protective covering system according to claim 1, further comprising at least one ballistic catching layer of woven fabric.

14. A protective covering system according to claim 1, wherein at least one said matrix layer is shrunken to adjust the spacing between the protective elements.

15. A protective covering system resistant to penetration of an object, comprising:

a plurality of matrix layers; arid a plurality of protective elements, each of at least two of the plurality of matrix layers having a plurality of said protective elements attached to the matrix layer in a uniform pattern, the protective elements being constructed and configured in respective matrix layers to resist penetration of an object upon contact of the object with said protective elements, at least one said matrix layer having a plurality of fibers, at least some of said protective elements comprising metallic staples secured to at least one said matrix layer, at least one said matrix layer having flexibility to bend 180 degrees in at least one direction with a radius of not more than approximately 0.5 inches, wherein each matrix layer has an areal density of at most 1.5 lbs. per square foot, and wherein the protective elements are attached to each matrix layer and the matrix layers oriented so that the protective elements provide a protective coverage area of less than 90% of total surface area of said system.

16. A protective covering system according to claim 15, said system being resistant to penetration of said objects having an energy of at least 25 joules presenting an impact area of at most $1\times10^{-6}$ square inches.

17. A protective covering system according to claim 15, wherein the protective elements are attached to each matrix layer and the matrix layers oriented so that the protective elements provide a protective coverage area of approximately 40% to 90% of total surface area of said system, and said system has an areal density of at most 2 lbs. per square foot.

18. A protective covering system resistant to penetration of an object, comprising:

a plurality of matrix layers; and a plurality of protective elements, each of at least two of the plurality of matrix layers having a plurality of said protective elements attached to the matrix layer in a uniform pattern, the protective elements being constructed and configured in respective matrix layers to resist penetration of an object upon contact of the object with said protective elements, at least one said matrix layer having a plurality of fibers, at least some of said protective elements comprising wire elements woven into at least one said matrix layer. wherein the protective elements are attached to each matrix layer and the matrix layers oriented so that the protective elements provide a protective coverage area of less than 90% of total surface area of said system, and wherein each matrix layer has an areal density of at most 1.5 lbs. per square foot.

19. A protective covering system according to claim 18, wherein the protective elements are attached to each matrix layer and the matrix layers oriented so that the protective elements provide a protective coverage area of approximately 40% to 90% of total surface area of said system, at least one said matrix layer having flexibility to bend 180 degrees in at least one direction with a radius of not more than approximately 0.5 inches, said system having an areal density of at most 2 lbs. per square foot.

20. A protective covering system according to claim 18, said system being resistant to penetration of said objects having an energy of at least 25 joules presenting an impact area of at most $1\times10^{31\ 6}$ square inches.

21. A protective covering system resistant to penetration of an object, comprising:

a plurality of matrix layers; and a plurality of protective elements, each of at least two of said matrix layers having a plurality of said protective elements attached to the matrix layer in a uniform pattern, the protective elements being constructed and configured in respective matrix layers to resist penetration of an object upon contact of the object with said protective eIements, at least one of said matrix layers having flexibility to bend 180 degrees in at least one direction with a radius of not more than approximately 0.5 inches.

* * * * *